US006829443B2

(12) United States Patent
Byun et al.

(10) Patent No.: US 6,829,443 B2
(45) Date of Patent: Dec. 7, 2004

(54) METHOD OF DETECTING TONER DEPLETION IN IMAGE FORMING APPARATUS

(75) Inventors: Seung-young Byun, Gyeonggi-do (KR); Woo-jung Shim, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/349,038

(22) Filed: Jan. 23, 2003

(65) Prior Publication Data

US 2003/0228157 A1 Dec. 11, 2003

(30) Foreign Application Priority Data

Jun. 11, 2002 (KR) ..... 10-2002-0032524

(51) Int. Cl.[7] ..... G03G 15/00

(52) U.S. Cl. ..... 399/12; 399/27

(58) Field of Search ..... 399/12, 24, 27

(56) References Cited

U.S. PATENT DOCUMENTS 5,204,698 A * 4/1993 LeSueur et al. ..... 399/42
5,950,043 A * 9/1999 Fujita et al. ..... 399/60
6,456,802 B1 * 9/2002 Phillips ..... 399/27

* cited by examiner

*Primary Examiner*—Quana Grainger
(74) *Attorney, Agent, or Firm*—Staas & Halsey LLP

(57) ABSTRACT

A method of detecting toner depletion in an image forming apparatus. The method includes comparing an accumulation pixel number Qt that is obtained by accumulating and counting a number of pixels of a printed image, with a reference pixel number Qr, calculated from an amount of toner received in a developing unit, and recognizing that the image forming apparatus is in a toner low state if the accumulation pixel number Qt is larger than the reference pixel number Qr. The method further includes comparing a concentration Di of the printed image with a predetermined reference concentration Dr and detecting toner depletion in the case of the toner low state. The method further includes determining whether the developing unit is a new developing unit, if the developing unit is reinstalled in the toner depletion state.

20 Claims, 7 Drawing Sheets

METHOD OF DETECTING TONER DEPLETION IN IMAGE FORMING APPARATUS

CROSS REFERENCE TO RELATED APPLICATION

This application claims the benefit of Korean Application No. 2002-32524, filed Jun. 11, 2002, in the Korean Intellectual Property Office, the disclosure of which is incorporated herein by reference.

BACKGROUND OF THE INVENTION

1. Field of the Invention

The present invention relates to a method of detecting toner depletion in an image forming apparatus, and more particularly, to a method of detecting toner depletion in an image forming apparatus having an improved structure, in which toner low and toner depletion states are detected without using an additional detection sensor.

2. Description of the Related Art

In general, image forming apparatuses using toner form an electrostatic latent image corresponding to a desired image by scanning light on a photosensitive body, develop the electrostatic latent image by supplying toner to the electrostatic latent image from a developing unit in which toner is received, transfer the developed electrostatic latent image onto paper, and fuse the transferred electrostatic latent image on the paper, thereby forming an image.

In such image forming apparatuses, it is possible to detect whether toner that is received in the developing unit is exhausted and to inform a user of the toner depletion, and the concentration of a developer needs to be properly adjusted so as to improve the efficiency of the developer.

FIG. 1 illustrates a conventional apparatus to detect the amount of toner remaining in a developing unit. As shown in FIG. 1, a sensing unit 120 is formed in a lower portion of a developing unit 100 and has an uneven shape, and transparent windows 121 are placed on the right and left sides of the sensing unit 120, respectively. A detection sensor 130, outside the developing unit 100, includes a light emitting unit 131 and a light receiving unit 132. The transparent windows 121 are placed between the light emitting unit 131 and the light receiving unit 132.

In addition, an agitator 110, having a shaft 111 and a wing 112, is installed in the developing unit 100. The agitator 110 distributes toner uniformly while rotating in the developing unit 100, and rubs and charges the toner to prepare for image development.

If the wing 112 passes through the sensing unit 120 while the agitator 110 rotates in the developing unit 100, the toner adhered to the transparent windows 121 is cleaned, and then, the toner is pushed into the sensing unit 120. This is done to prevent sensing errors, which may be caused by toner adhered to the transparent windows 121 by static electricity and moisture. Such errors cause the sending unit 120 to detect toner even when toner does not remain in the developing unit 100.

Because of the above structure, light emitted from the light emitting unit 131 passes through the toner of the sensing unit 120 and is detected by the light receiving unit 132. In this case, the amount of light detected by the light receiving unit 132 depends on the amount of the toner remaining in the sensing unit 120. Hence, after the relation between the amount of light detected by the light receiving unit 132 and the amount of toner remaining in the sensing unit 120 is experimentally obtained, the amount of toner remaining in the developing unit 100 can be calculated using the experimental result.

However, the conventional apparatus to detect the amount of toner remaining in the developing unit 100 shown in FIG. 1 detects the amount of toner remaining only in a partial region of the developing unit 100, i.e., only in the sensing unit 120. Thus, the conventional apparatus shown in FIG. 1 determines that the toner is exhausted and displays a toner depletion message if toner does not remain in the sensing unit 120, even when toner remains in another region of the developing unit 100. Hence, a user cannot rely on the toner depletion message. Also, an additional detection sensor 130 should be provided, and thus overall costs of the apparatus increase.

In addition, even though the agitator 110 cleans the transparent windows 121 while rotating in the developing unit 100, when an image forming apparatus does not perform a print operation and is in a print standby state for a long time, or when the image forming apparatus is turned off for a long time and thus toner adheres to the transparent windows 121, the agitator 110 may not completely clean the transparent windows 121. In this case, although toner is completely exhausted, it may be determined by the detection sensor 130 that toner remains in the sensing unit 120.

In another method of detecting toner depletion in an image forming apparatus, the number of pixels printed from an initial time when the developing unit is used is counted without using the detection sensor shown in FIG. 1, and a toner depletion message is displayed if the number of pixels reaches a predetermined value. This method can be used only if the amount of toner required to print one pixel is uniform. However, the amount of toner that is actually used varies according to the concentration of an image printed even when the same number of pixels is printed. Thus, in the above method, the accuracy of detecting toner depletion is poor.

SUMMARY OF THE INVENTION

Accordingly, it is an aspect of the present invention to provide a method of detecting toner depletion in an image forming apparatus, in which a toner low state or a toner depletion state is detected by counting the number of pixels of a printed image without using an additional detection sensor, and by periodically detecting the concentration of the printed image.

Additional aspects and advantages of the invention will be set forth in part in the description which follows and, in part, will be obvious from the description, or may be learned by practice of the invention.

The foregoing, and/or other aspects may be achieved by providing a method of detecting toner depletion in an image forming apparatus which includes a photosensitive medium, a laser scanning unit to scan light on the photosensitive medium and to form an electrostatic latent image thereon, a developing unit to supply toner to the electrostatic latent image and thereby form a toner image, and an image controller to control the forming of the toner image. The method includes comparing an accumulation pixel number Qt obtained by accumulating and counting a number of pixels of the formed image with a reference pixel number Qr, calculated from an amount of toner initially received by the developing unit, and recognizing that the image forming apparatus is in a toner low state if the accumulation pixel number Qt is larger than the reference pixel number Qr, comparing a concentration of the formed image with a reference concentration Dr and detecting a toner depletion state if it is recognized that the image forming apparatus is in the toner low state; determining whether the developing unit is reinstalled; and determining whether the developing unit is a new developing unit, if it is determined that the developing unit is reinstalled.

The reference pixel number Qr may be set to be smaller than a quotient obtained by dividing the amount of toner that is initially received in the developing unit by the amount of toner required to print one pixel.

The method may further include detecting whether the amount of toner received in the developing unit is in a toner low state or a toner depletion state, if the image forming apparatus is turned on. The detecting includes checking a toner depletion state variable TE stored in the image controller and detecting whether the image forming apparatus is in the toner depletion state, and checking a toner low state variable TL stored in the image controller, and detecting whether the image forming apparatus is in the toner low state.

The comparing of the concentration may include forming a test patch to measure the concentration of the formed image printed per a predetermined print number Pr1; detecting the image concentration Di from the test patch, and comparing the image concentration Di with the reference concentration Dr, recognizing that the image forming apparatus is in the toner depletion state if the image concentration Di is lower than the reference concentration Dr, and forming another test patch if it is determined that the image concentration Di is not lower than the reference concentration Dr.

The test patch may have at least three different toner coverages. Also, the image concentration Di can be detected from the test patch that is formed on the photosensitive medium and can also be detected from the test patch that is transferred onto a transfer medium onto which the toner image formed on the photosensitive medium is transferred.

The forming of the test patch and the comparing of the image concentration may be repeated and it is recognized that the image forming apparatus is in the toner depletion state if the image concentration Di is lower than the reference concentration Dr, and the forming of the test patch is again repeated if the image concentration Di is not lower than the reference concentration. The comparing of the image concentration may include adjusting development variables so that the image concentration Di is the same as the reference concentration Dr when the method repeats the forming of the test pattern. The adjusting of the development variables may include applying a development bias voltage to a developing roller installed in the developing unit to supply the toner to the photosensitive medium, and/or adjusting an optical output of the laser scanning unit to scan light on the photosensitive medium and to form the electrostatic latent image.

The determining whether the developing unit is new includes detecting whether the developing unit is reinstalled, forming a test patch for measuring the concentration of an image printed per a predetermined print number Pr2, detecting the image concentration Di from the test patch, and comparing the image concentration Di with the reference concentration Dr, resetting the accumulation pixel number Qt to "0" and repeating the comprising of the accumulation pixel number if the image concentration Di is not lower than the reference concentration Dr, and repeating the comparing of the formed mage if the image concentration Di is lower than the reference concentration Dr.

In the comparing of Di with Dr, the determining whether the developing unit is reinstalled, the forming of the test patch, and the image concentration from the test patch are repeated (m) times. Furthermore, the accumulation pixel number Qt is reset to "0" and the method returns to the comparing of the accumulation pixel number if the image concentration Di is not lower than the reference concentration Dr, and the method returns to the comparing of the concentration of the formed image if the image concentration Di is lower than the reference concentration Dr. Also, the comparing of the image concentration is repeated (m) times, and it is recognized that the image forming apparatus is in the toner depletion state if the image concentration Di is lower than the reference concentration Dr.

According to the above method, errors of detecting toner depletion can be minimized in consideration of the number of pixels of an image printed and the concentration of the image.

BRIEF DESCRIPTION OF THE DRAWINGS

These and other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
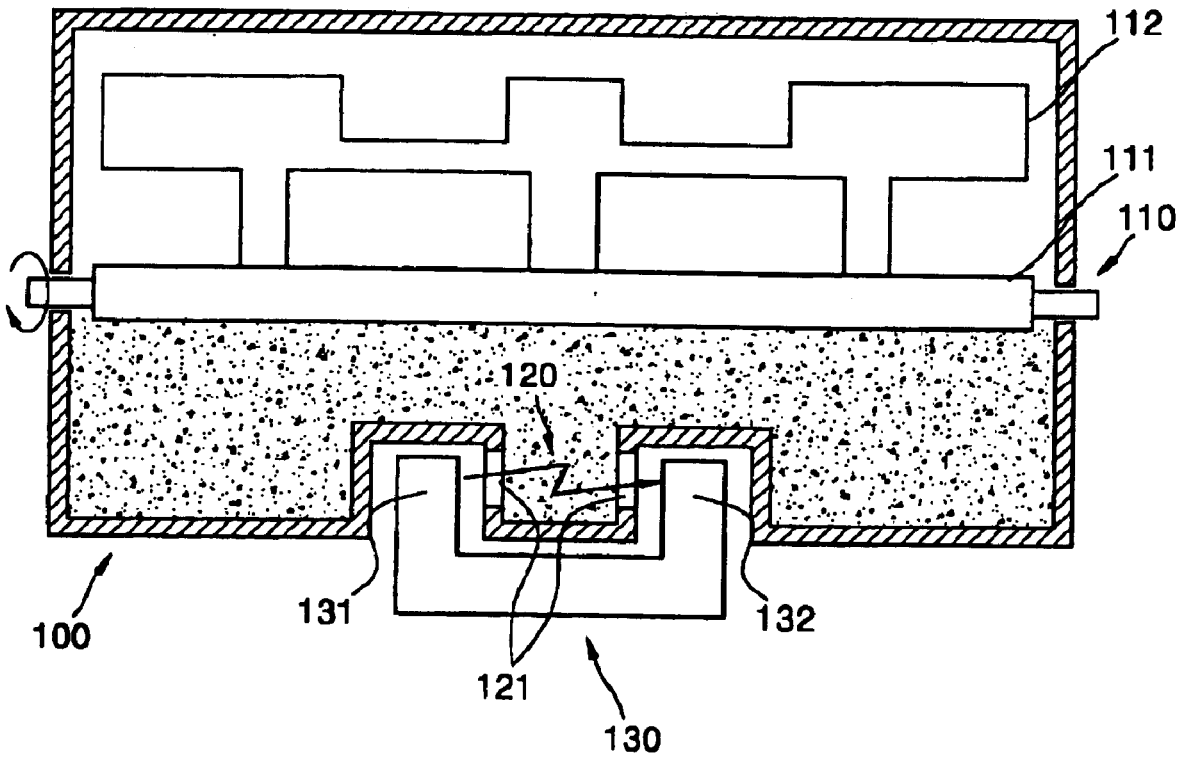
FIG. 1 (PRIOR ART)
FIG. 1 illustrates a conventional apparatus to detect the amount of toner remaining in a developing unit.

Reference will now be made in detail to the present preferred embodiments of the present invention, examples of which are illustrated in the accompanying drawings, wherein like reference numerals refer to like elements throughout.

Figure 2:
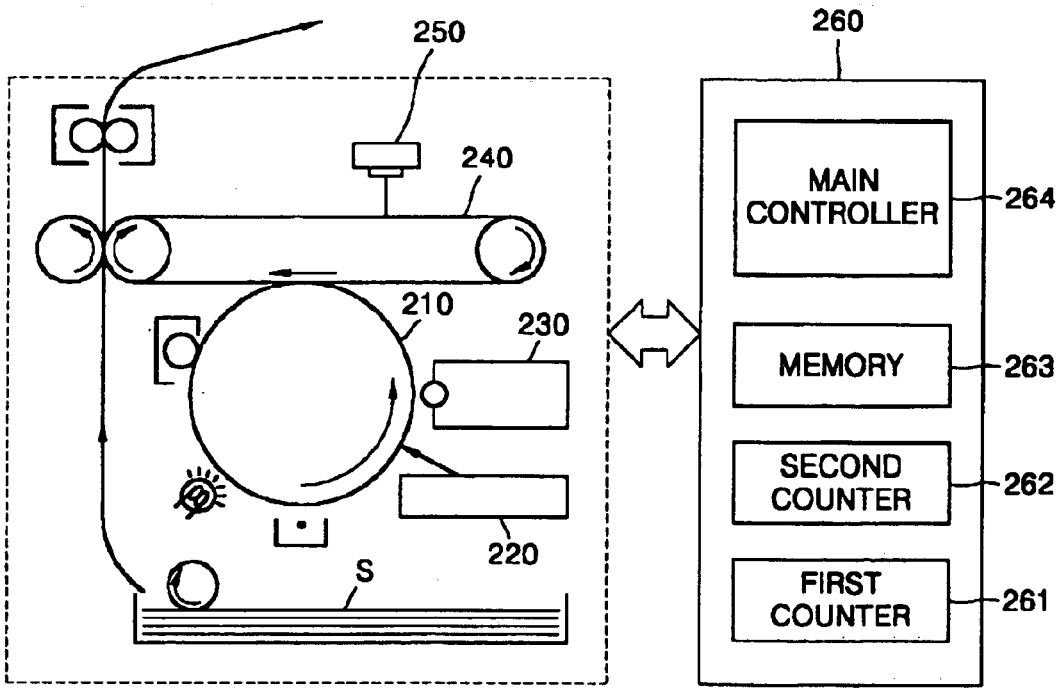
FIG. 2 illustrates an embodiment of an image forming apparatus, by which a method of detecting toner depletion according to an embodiment of the present invention is implemented.

A method of detecting toner depletion according to an embodiment of the present invention may be applied to an image forming apparatus having the structure shown in FIG. 2.

As shown in FIG. 2, the image forming apparatus includes a photosensitive drum 210, a laser scanning unit (LSU) 220, a developing unit 230, a transfer belt 240, and an image controller 260.

In the image forming apparatus shown in FIG. 2, the photosensitive drum 210 is used as a photosensitive medium, but a photosensitive belt may also be used as the photosensitive medium. In addition, the transfer belt 240 is used as a transfer medium, but a transfer drum may also be used as the transfer medium.

If image information is transmitted to the LSU 220 from the image controller 260, the LSU 220 scans light corresponding to the image information on the photosensitive drum 210 and forms an electrostatic latent image. Then, toner is supplied from the developing unit 230, the electrostatic latent image is developed as a toner image, the toner image is transferred onto the transfer belt 240, and then is transferred onto paper S and is fused on the paper S, thereby forming an image.

A developing unit detection sensor (not shown) which determines whether the developing unit 230 is reinstalled, is further provided in the image forming apparatus. The developing unit detection sensor can detect only that the developing unit 230 is reinstalled after being removed from the image forming apparatus. It is apparent that the developing unit detection sensor cannot detect whether the developing unit 230 has been replaced. The developing unit detection sensor transmits a signal to the image controller 260 indicating whether the developing unit 230 is reinstalled.

A toner concentration detection sensor 250, which detects the concentration of a printed image, is further provided in the image forming apparatus. In general, the toner concentration detection sensor 250 is adjacent to the photosensitive drum 210 or the transfer belt 240 to detect the concentration of an image from a test patch. In general, when the image forming apparatus is turned on or off for a long time and restarts a print operation, the test patch is first formed, and the concentration of the test patch is detected using the toner concentration detection sensor 250. When the detected concentration is different from a predetermined reference concentration, the concentration of the image is controlled by adjusting development control variables, such as a development bias voltage applied to the developing unit 230 and an optical output of the LSU 220.

The image controller 260 serves to control all operations of the image forming apparatus. The image controller 260 includes a first counter 261 which counts the number of pixels of a printed image, a second counter 262 which counts the number of images printed, and a memory 263 in which various information to control the image forming apparatus is stored, and a main controller 264, which is a central processing unit. Variables to control the image forming apparatus are a reference pixel number Qr, a first reference print number Pr1, a second reference print number Pr2, reference concentration information Dr, test patch information, a toner low state variable TL, and a toner depletion state variable TE.

Hereinafter, the method of detecting toner depletion according to the embodiment of the present invention will be described with reference to FIG. 3 and FIG. 4A through 4C.

Figure 3:
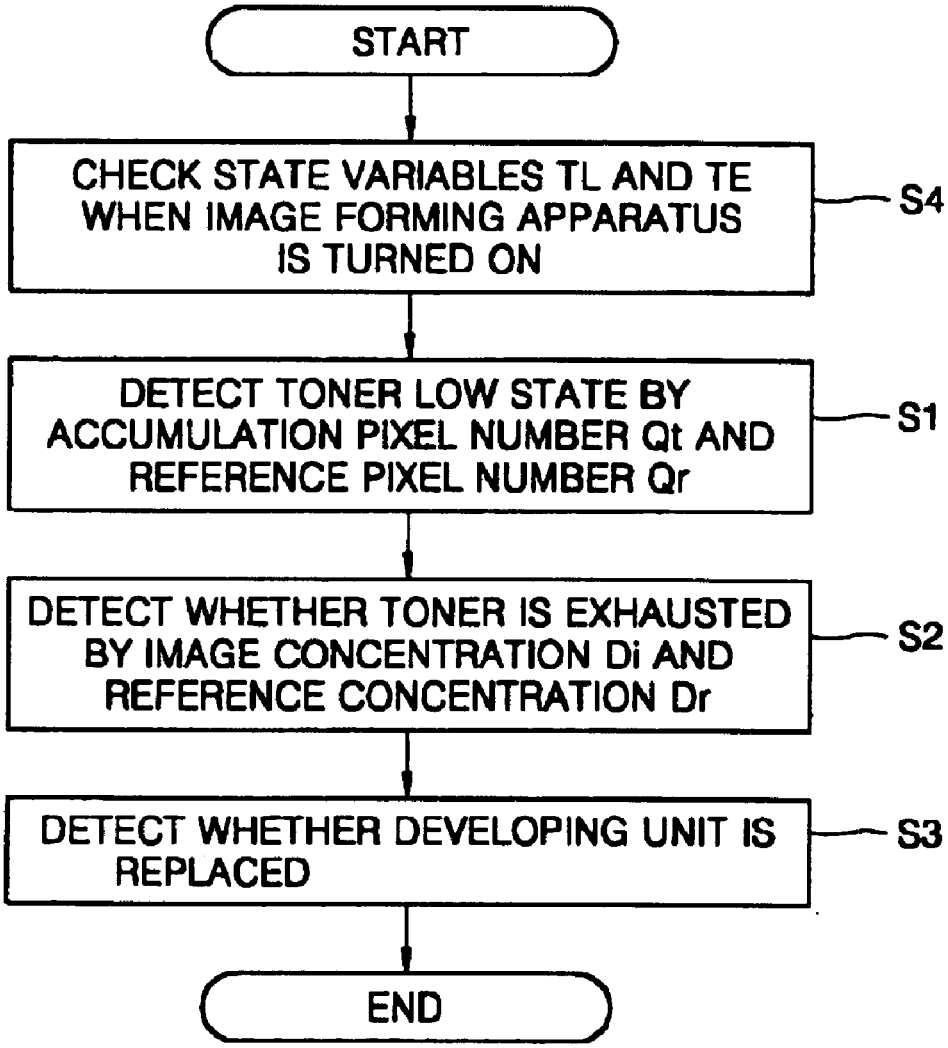
FIG. 3 is a flowchart illustrating the embodiment of the method of detecting toner depletion according to the present invention.

As shown in FIG. 3, the method includes a first operation S1 of comparing an accumulation pixel number Qt with a reference pixel number Qr and detecting a toner low state, and a second operation S2 of comparing an image concentration Di with a reference concentration Dr and detecting a toner depletion state. The method further includes a third operation S3 of detecting whether the developing unit 230 has been replaced.

The method further includes a fourth operation S4 of detecting a toner low state or a toner depletion state by checking a toner low state variable TL and a toner depletion state variable TE when the image forming apparatus is turned on. The toner low state TL or the toner depletion state TE can be detected without performing operations S1 and S2 when the image forming apparatus is turned on after being turned off in the toner low state TL or the toner depletion state TE.

Figure 4A:
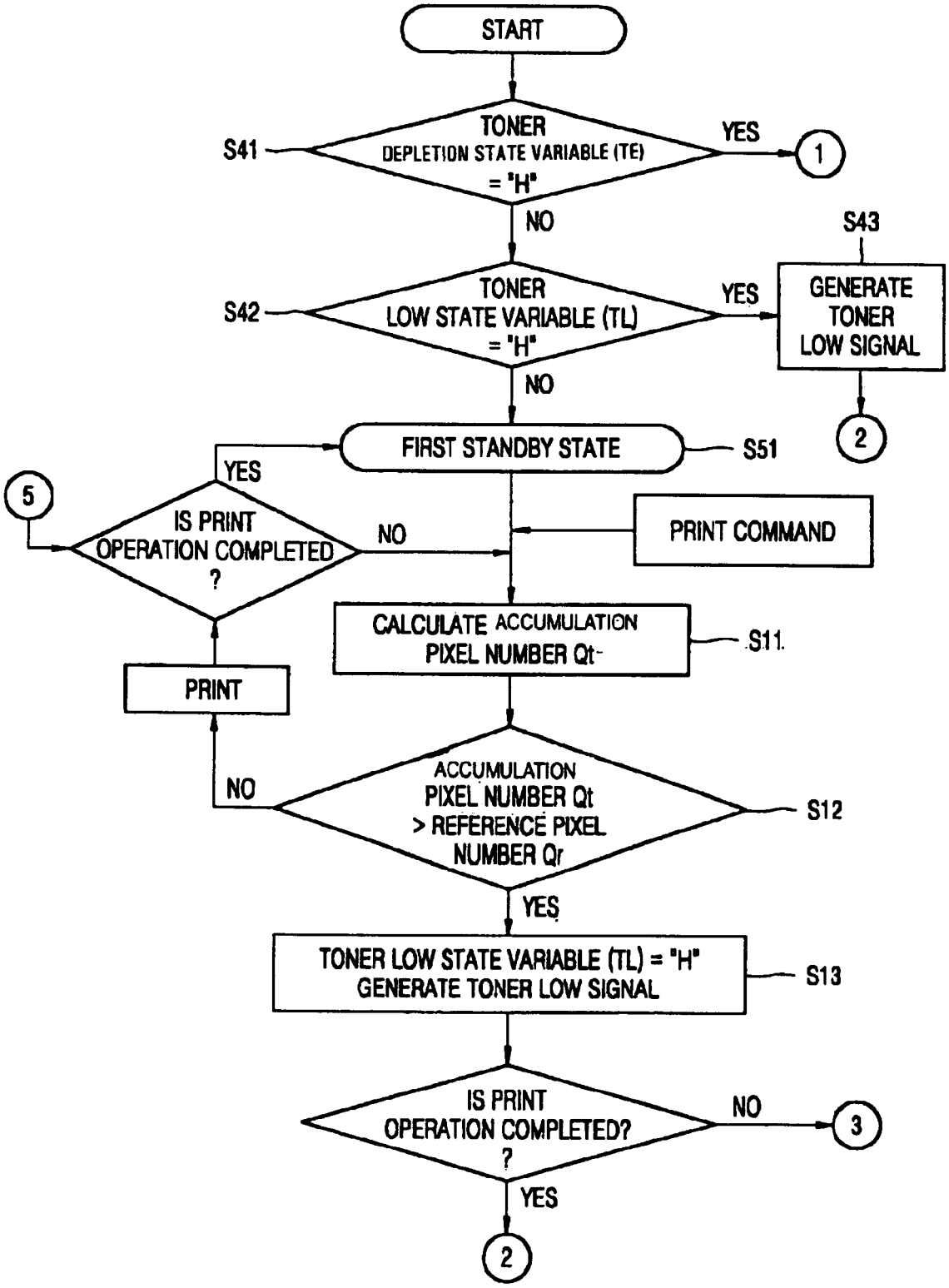
FIG. 4A is a flowchart illustrating operations S4 and S1 shown in FIG. 3.
Figure 4B:
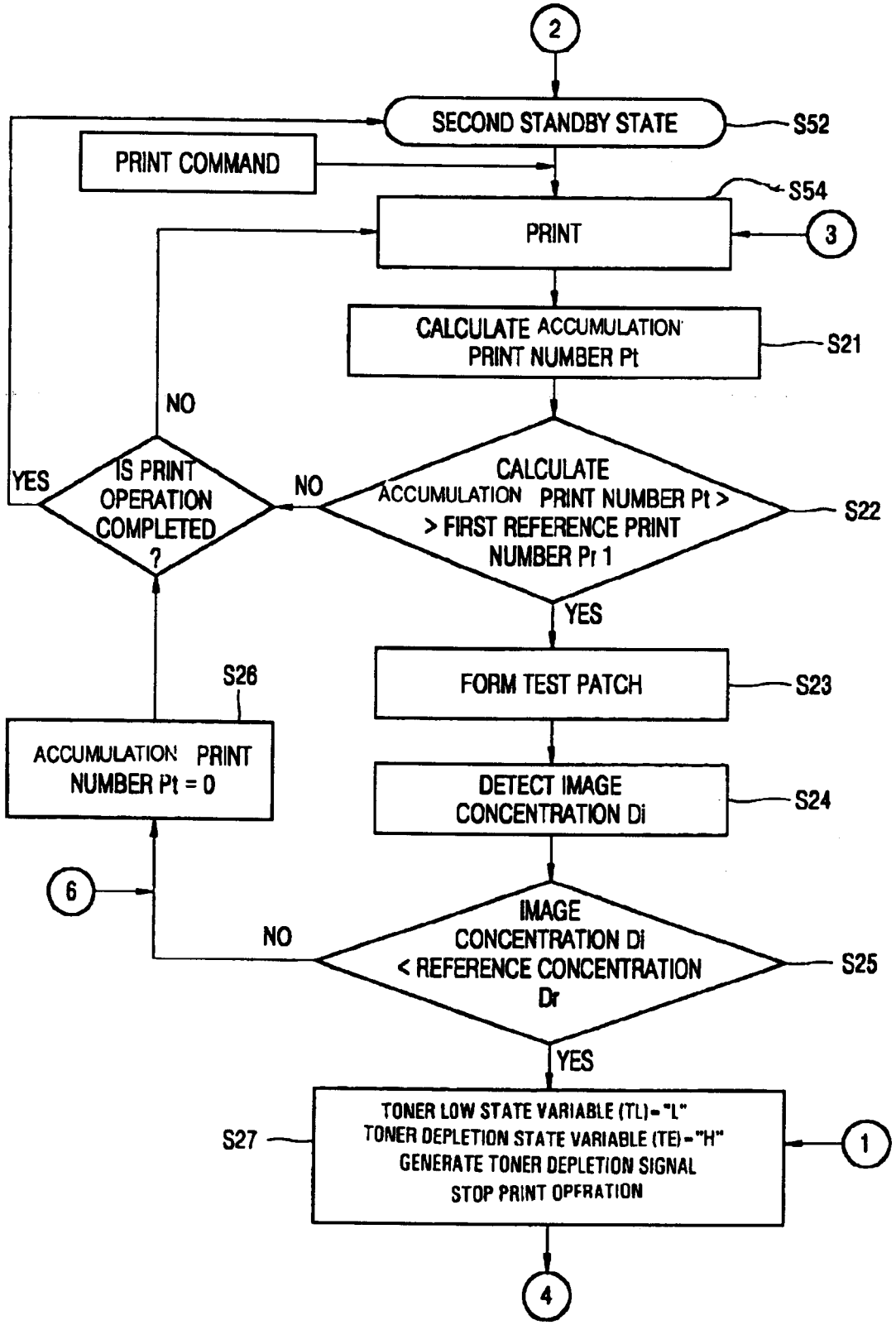
FIG. 4B is a flowchart illustrating operation S2 shown in FIG. 3.
Figure 4C:
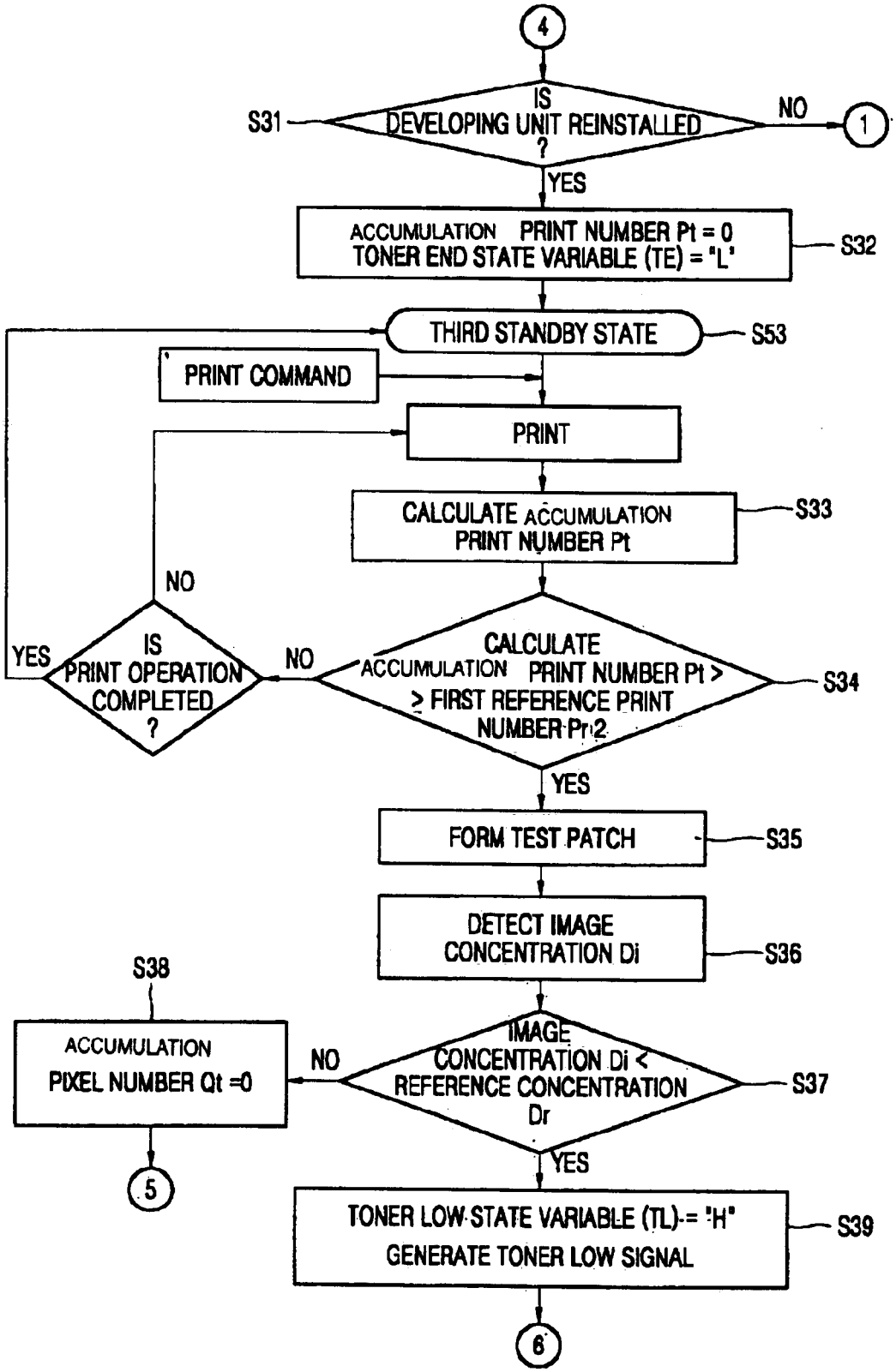
FIG. 4C is a flowchart illustrating operation S3 shown in FIG. 3.

FIG. 4A is a flowchart illustrating operations S4 and S1 shown in FIG. 3, FIG. 4B is a flowchart illustrating operation S2 shown in FIG. 3, and FIG. 4C is a flowchart illustrating operation S3 shown in FIG. 3.

Referring to FIG. 4A, if the image forming apparatus shown in FIG. 2 is turned on, the main controller 264 checks the toner low state variable TL and the toner depletion state variable TE, which are stored in the memory 263.

If the toner depletion state variable TE is checked in operation S41 and is high (H), the method proceeds to point ① of the flowchart, and a toner depletion signal is generated in operation S27 so that a user becomes aware of the toner depletion. The image forming apparatus then stops the print operation and waits for the replacement of the developing unit 230. Next, if the toner low state variable TL checked in operation S42 is high (H), the toner low signal TL is generated in operation S43 so that the user becomes aware of the toner low state, and the method proceeds to point ② of the flowchart. The image forming apparatus then waits in a second standby state (in operation S52 of FIG. 4B). However, if the toner low state variable TL is not high (H), the image forming apparatus waits in a first standby state in operation S51.

If a print command is transmitted to the image controller 260 in the first standby state with the image information, the image forming apparatus performs the print operation. In this case, the first counter 261 counts the number of pixels of the printed image and calculates the accumulation pixel number Qt in operation S11 and transmits the calculated accumulation pixel number Qt to the main controller 264.

The reference pixel number Qr is stored in the memory 263. The reference pixel number Qr can be obtained by dividing the amount of toner that is initially received in the developing unit 230 by the amount of toner required to print one pixel. However, the amount of toner required during the print operation varies according to a development bias voltage, an optical output of the LSU 220, temperature, and moisture. Accordingly, the reference pixel number Qr is set to be slightly smaller than a quotient obtained by dividing the amount of toner that is initially received in the developing unit 230 by the amount of toner required to print one pixel. As a result, a problem in which toner is exhausted, although the accumulation pixel number Qt is smaller than the reference pixel number Qr, can be solved.

In operation S12, the main controller 264 compares the accumulation pixel number Qt with the reference pixel number Qr that is stored in the memory 263.

If the accumulation pixel number Qt is not larger than the reference pixel number Qr, the image forming apparatus waits in the first standby state (S51) after the print operation is completed.

If the accumulation pixel number Qt is larger than the reference pixel number Qr, in operation S13, the toner low state variable TL is changed into high (H), and the toner low signal is generated so that the user can know that toner is low. Next, it is checked whether the print operation is completed. If the print operation is completed, the method proceeds to point ② of the flowchart, and the image forming apparatus waits in the second standby state (in operation S52 of FIG. 4B). If the print operation is not completed, the method proceeds to operation S54 of FIG. 4B along point ③ of the flowchart, and the print operation is continuously performed. In this case, the same operation if the print command is inputted to the image controller 260 when the image forming apparatus is in a toner low state (described later), is performed.

Referring to FIG. 4B, if the print command is input to the image controller 260 when the image forming apparatus is in the toner low state, the second counter 262 counts a print number, calculates an accumulation print number Pt in operation S21 and transmits the calculated accumulation print number Pt to the main controller 264. Then, in operation S22, the main controller 264 compares the first reference print number Pr1 that has been previously stored in the memory 263 with the accumulation print number Pt.

The first reference print number Pr1 refers to the interval of checking an image concentration Di defined by a print number so as to detect toner depletion in the toner low state. If the first reference print number Pr1 is too small, use of toner to form a test patch (described later) increases too much, and thus the efficiency of toner use is lowered. If the first reference print number Pr1 is too large, the print operation may be performed when the toner is completely exhausted. Thus, an optimum value is determined depending on how many print numbers in the toner depletion state are allowed according to the specifications of the image forming apparatus, and in consideration of the amount of toner that is expected to remain in the developing unit 230 after the toner low signal is generated. For example, if the first reference print number Pr1 is set to 10, a maximum of 10 sheets can be printed in the toner depletion state, and if the capacity of the toner of the developing unit 230 is for 1000 sheets, 1% of a maximum print capacity is allowed to be printed when the toner is completely exhausted.

If the main controller 264 compares the first reference print number Pr1 with the accumulation print number Pt and the accumulation print number Pt is smaller than the first reference print number Pr1, the method proceeds to the second standby state (S52) after the print operation is completed.

If the accumulation print number Pt is larger than the first reference print number Pr1, the image forming apparatus forms a test patch using the test patch information stored in the memory 263.

The test patch information may have at least three different toner coverages, meaning the percentage of a toner area to a print area. Thus, the test patch information may have three toner coverages, such as 100%, 60%, and 20%, for example.

The test patch information is transmitted to the LSU 220. Then, in operation S23, the LSU 220 scans light corresponding to the test patch information on the photosensitive drum 210, forms an electrostatic latent image, develops the electrostatic latent image using the developing unit 230 and forms the test patch. Next, the toner concentration detection sensor 250 detects the image concentration Di as a voltage Vt from the test patch in operation S24, and transmits the detected voltage Vt to the main controller 264. When the test patch information has three coverages, three voltages Vt corresponding to the image concentration Di are outputted by the toner concentration detection sensor 250. The image concentration Di may be detected from the test patch that is transferred onto the transfer belt 240.

In operation S25, the main controller 264 compares the image concentration Di with a reference concentration Dr that is stored in the memory 263.

The reference concentration Dr is determined from the relationship between the toner coverage of the printed image and a voltage Vt outputted by the toner concentration detection sensor 250.

Figure 5:
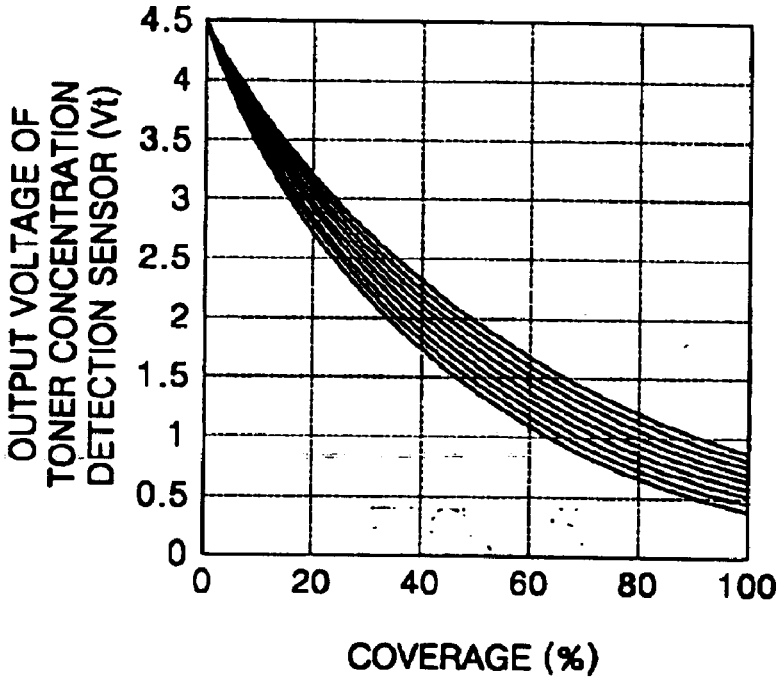
FIG. 5 is a graph illustrating the relation between an output voltage (Vt) of a toner concentration detection sensor and toner coverage.
Figure 6:
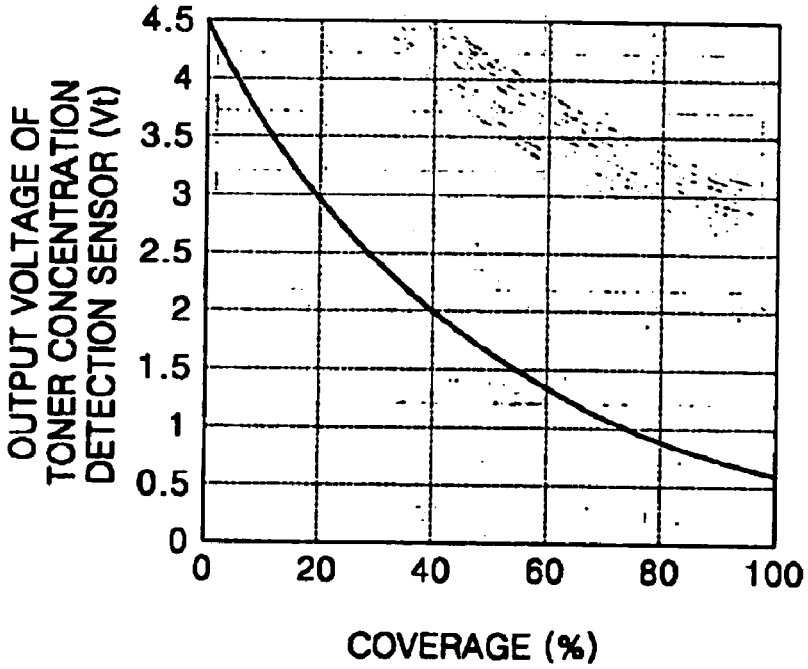
FIG. 6 is a graph showing a reference concentration according to the toner coverage by the output voltage (Vt) of the toner concentration detection sensor.

FIG. 5 is a graph illustrating a relation between] the voltage Vt of the toner concentration detection sensor 250 and the toner coverage. As shown in FIG. 5, the voltage Vt decreases as the toner coverage increases. Since the amount of toner that adheres to the photosensitive drum 210 from the developing unit 230 varies according to development variables, such as temperature, a development bias voltage, and an optical output of the LSU 220, the voltage Vt varies even for the same toner coverage. Therefore, the reference concentration Dr according to the toner coverage may be stored in the memory 263 in standard development conditions by standardizing the development variables, as shown in FIG. 6.

If the image concentration Di is lower than the reference concentration Dr, in operation S27, the main controller 264 changes the toner depletion state variable TE into high (H) and the toner low state variable TL into low (L), generates a toner depletion signal so that the user becomes aware of the toner depletion, and stops the print operation. The method proceeds to point ④ of the flowchart, and the image forming apparatus waits for the developing unit 230 to be reinstalled in operation S31. If the image concentration Di is not lower than the reference concentration Dr, the main controller 264 resets an accumulation print number Pt to "0" in operation S26, and the print operation is completed, and the method proceeds to the second standby state (S52).

Here, in order to generate the toner depletion signal, the number (n) of operations S21 through S26 can be repeated, and when the image concentration Di is lower than the reference concentration Dr, the toner depletion signal can be generated and the print operation can stop. This is why the toner concentration detection sensor 250 cannot always precisely detect the image concentration Di. The number (n) of the operations S21 through S26 is determined according to the result of repeated experiments on whether the toner in the developing unit 230 is actually exhausted when the image concentration Di is lower than the reference concentration Dr, and depending on how many print jobs in the toner depletion state are possible. These factors are determined according to the specifications of the image forming apparatus, as when the first reference print number Pr1 is determined (as described previously). For example, when the first reference print number Pr1 is set to 10 and operations S21 through S26 are repeated three times, a maximum of 30 sheets can be printed in the toner depletion state.

In addition, the number (n) of repetitions of operations S21 through S26 allows the toner to remain in the developing unit 230 even when the image concentration Di is lower than the reference concentration Dr. Thus, if development variables, such as the development bias voltage and/or an optical output of the LSU 220, are adjusted, between operations S25 and S26, so that the image concentration Di is the same as the reference concentration Dr, deterioration of the image can be prevented even in the state near the toner depletion state. In general, the concentration of an image increases if the development bias voltage and the optical output of the LSU 220 are increased.

Referring to FIG. 4C, in operation S31, after the toner depletion signal is generated, the image forming apparatus stops the print operation and waits for the developing unit 230 to be reinstalled. If a signal indicating the developing unit 230 is reinstalled is inputted to the image controller 260 from a developing unit detection sensor (not shown), the image forming apparatus changes the toner depletion state variable TE into low (L) (operation S32) and removes the toner depletion signal. The image forming apparatus also resets the accumulation print number Pt to "0" in operation S32, and then the image forming apparatus is in a third standby state (S53) and waits for a print command. In this case, if the development variables are adjusted so as to prevent deterioration of an image when toner depletion is detected, the development variables may be returned to standard development conditions.

If the print command is inputted to the image controller 260, in operation S33, the print operation is performed by increasing the accumulation print number Pt per print number. In operation S34, the main controller 264 compares the accumulation print number Pt with the second reference print number Pr2. In operation S35, the main controller 264 forms a test patch to check the concentration of the image if the accumulation print number Pt is larger than the second reference print number Pr2. In operation S36, the main controller 264 detects the image concentration Di from the test patch. In operation S37, the main controller 264 compares the image concentration Di with the reference concentration Dr. In operation S38, the accumulation pixel number Qt is reset to "0" when the image concentration Di is not lower than the reference concentration Dr. Then, the method proceeds to point ⑤ of the flowchart, the print operation is completed, and the image forming apparatus is in the first standby state (S51).

More specifically, even though the signal indicating that the developing unit 230 is reinstalled is inputted to the image controller 260 from the developing unit detection sensor, it cannot be known whether a new developing unit 230 is installed, and thus, it is determined that the new developing unit 230 is installed when the image concentration Di is not lower than the reference concentration Dr after the second reference print number Pr2 is printed.

The second reference print number Pr2 indicates that the interval of checking the image concentration Di is defined by a print number so as to detect whether the new developing unit 230 is reinstalled, and thus an optimum value is determined depending on how many print numbers in the toner depletion state are allowed, according to the specifications of the image forming apparatus, as for the first reference print number Pr1.

If the image concentration Di is lower than the reference concentration Dr, in operation S39, it is determined as the toner low state, the toner low state variable TL is changed into high (H), and the toner low signal is generated. The method then proceeds to point ⑥ of the flowchart, the accumulation print number Pr is reset to "0" (S26), the print operation is completed, and the image forming apparatus is in the second standby state (S52).

This is to prevent toner depletion detection errors from occurring when the user simply removes the developing unit 230 from the image forming apparatus and reinstalls the developing unit 230. In this case, the developing unit 230 is determined to be a new developing unit 230 and the method returns to the first operation of detecting a toner low state by comparing the accumulation pixel number Qt with the reference pixel number Qr.

In addition, in consideration of errors in detecting by the toner concentration detection sensor 250, operations S33 through S37 are repeated (m) times, and thus it can be determined that a new developing unit 230 is installed when the image concentration Di is not lower than the reference concentration Dr. In this case, if the image concentration Di is lower than the reference concentration Dr as the result of repeating operations S33 through S37 (m) times, the toner depletion signal can be generated, and the print operation can stop. This is to prevent the image concentration from unnecessarily checking according to a first reference print number Pr1, due to the errors of detecting the toner concentration detection sensor 250 when the toner low state is recognized, although the new developing unit 230 is installed.

As described above, the method of detecting toner depletion in the image forming apparatus according to the embodiment of the present invention has the following advantages.

First, an additional sensor to detect the amount of toner remaining in the developing unit is not attached to the developing unit, and thus errors in detection caused by the contaminated transparent windows of the sensing unit, as in the conventional apparatus, do not occur.

Second, since the toner concentration detection sensor to detect the concentration of the printed image is generally provided in the image forming apparatus, so as to control development conditions, an additional sensor need not be provided so as to detect toner depletion, and thus costs can be reduced.

Third, the reliability of detecting toner depletion can be improved by considering the number of pixels of a printed image and the concentration of the image. In addition, toner depletion can be detected when the toner in the developing unit is completely exhausted, and thus the amount of toner that is unused and thrown away can be minimized.

Fourth, the concentration of the image is checked at predetermined intervals of time, and the development variables are controlled even in the toner low state, and thus deterioration of image quality can be prevented.

Although a few preferred embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A method of detecting toner depletion in an image forming apparatus which comprises a photosensitive medium, a laser scanning unit to scan light on the photosensitive medium and to form an electrostatic latent image thereon, a developing unit to supply toner to the electrostatic latent image and thereby form a toner image, and an image controller to control the forming of the toner image, the method comprising:

calculating a reference pixel number Qr from an amount of toner initially received by the developing unit;

comparing an accumulation pixel number Qt obtained by accumulating and counting a number of pixels of the formed image, with the reference pixel number Qr, and recognizing that the image forming apparatus is in a toner low state if the accumulation pixel number Qt is larger than the reference pixel number Qr;

comparing a concentration of the formed image Di with a reference concentration Dr and detecting a toner depletion state upon recognizing that the image forming apparatus is in the toner low state;

determining whether the developing unit is reinstalled; and determining whether the developing unit is a new developing unit, upon determining that the developing unit is reinstalled.

2. The method of claim 1, further comprising:

dividing the amount of toner that is initially received by an amount of toner requested to print one pixel; and setting the reference pixel number Qr to be smaller than a quotient obtained by the dividing.

3. The method of claim 1, further comprising: determining whether the image forming apparatus is turned on; and detecting whether the amount of toner initially received in the developing unit is in the toner low state or the toner depletion state, upon determining that the image forming apparatus is turned on.

4. The method of claim 3, wherein the detecting of the amount of toner initially received comprises:

checking a toner depletion state variable TE stored in the image controller and detecting whether the image forming apparatus is in the toner depletion state; and checking a toner low state variable TL stored in the image controller, and detecting whether the image forming apparatus is in the toner low state.

5. The method of claim 4, wherein the checking of the toner depletion state variable is first performed, and the checking of the toner low state variable is performed upon determining that the image forming apparatus is not in the toner depletion state.

6. The method of claim 1, wherein the comparing of the concentrations comprises:

forming a test patch to measure the concentration of the formed image per a predetermined print number Pr1;

detecting the image concentration Di from the test patch; and comparing the image concentration Di with the reference concentration Dr, recognizing that the image forming apparatus is in the toner depletion state upon determining that the image concentration Di is lower than the reference concentration Dr, and forming another test patch upon determining that the image concentration Di is not lower than the reference concentration Dr.

7. The method of claim 6, wherein the test patch has three different toner coverages.

8. The method of claim 6, wherein the test patch is formed on the photosensitive medium and the detecting of the image concentration Di comprises detecting the test patch that is formed on the photosensitive medium.

9. The method of claim 6, wherein the forming of the test patch comprises forming the test patch on the photosensitive medium and transferring the test patch to a transfer medium, and the detecting of the image concentration comprises detecting from the test patch that is transferred onto the transfer medium.

10. The method of claim 6, wherein the forming of the test patch and the comparing of the image concentration are repeated (n) times, and the comparing of the image concentration further comprises recognizing that the image forming apparatus is in the toner depletion state upon determining that the image concentration Di is lower than the reference concentration Dr, and the forming of the test patch is repeated upon determining that the image concentration Di is not lower than the reference concentration.

11. The method of claim 10, wherein the comparing of the image concentration comprises adjusting development variables so that the image concentration Di is the same as the reference concentration Dr when the method repeats the forming of the test pattern.

12. The method of claim 11, wherein the adjusting of the development variables comprises applying a development bias voltage to a developing roller installed in the developing unit to supply toner to the photosensitive medium, and/or adjusting an optical output of the laser scanning unit to scan light on the photosensitive medium and form the electrostatic latent image.

13. The method of claim 1, wherein the determining whether the developing unit is new comprises:

detecting whether the developing unit is reinstalled;

forming a test patch to measure the concentration of the formed image Di per a predetermined print number Pr2;

detecting the image concentration Di from the test patch;

comparing the image concentration Di with the reference concentration Dr;

resetting the accumulation pixel number Qt to "0" and repeating the comparing of the accumulation pixel number upon determining that the image concentration Di is not lower than the reference concentration Dr; and repeating the comparing of the concentration of the formed image upon determining that the image concentration Di is lower than the reference concentration Dr.

14. The method of claim 13, wherein the detecting whether the developing unit is installed, the forming of the test patch, and the detecting of the image concentration from the test patch are repeated (m) times, and the comparing of the image concentration Di comprises:

resetting the accumulation pixel number Qt to "0," and repeating the comparing of the accumulation pixel number upon determining that the image concentration Di is not lower than the reference concentration Dr; and repeating the comparing of the concentration of the formed image upon determining that the image concentration Di is lower than the reference concentration Dr.

15. The method of claim 14, wherein the comparing of the image concentration Di is repeated (m) times, and the comparing of the image concentration comprises recognizing that the image forming apparatus is in the toner depletion state upon determining that the image concentration Di is lower than the reference concentration Dr.

16. A method, comprising:

determining a number of pixels in a printed image formed of toner;

determining whether the determined number of pixels is greater than a reference number;

determining a concentration of the toner upon determining that the determined number of pixels is greater than the reference number; and determining a toner depletion state based upon the determined concentration.

17. The method of claim 16, further comprising:

determining the reference number based on an initial amount of the toner.

18. The method of claim 16, wherein the determining of the toner depletion state comprises:

comparing the determined concentration with a reference concentration.

19. An apparatus comprising:

a photosensitive element, a latent electrostatic image being formed thereon;

a developer to develop the latent electrostatic image using a toner;

a transfer element to receive the developed image; and a toner concentration sensor, opposite the transfer element, to selectively detect a concentration of the toner in the received image and determine a toner depletion state based on the detected concentration.

20. The apparatus of claim 19, further comprising:

a comparing unit to compare a number of pixels in the developed image with a reference number, wherein the toner concentration sensor detects the concentration of the toner when the number of pixels is greater than the reference number.

* * * * *

UNITED STATES PATENT AND TRADEMARK OFFICE

CERTIFICATE OF CORRECTION

PATENT NO. : 6,829,443 B2
DATED : December 7, 2004
INVENTOR(S) : Byun et al.

It is certified that error appears in the above-identified patent and that said Letters Patent is hereby corrected as shown below:

Column 11,
Line 1, after "comprising:" move "determining" to second line of claim.

Signed and Sealed this

Twenty-seventh Day of December, 2005

JON W. DUDAS
*Director of the United States Patent and Trademark Office*